US006299977B1

(12) United States Patent
Takeyama et al.

(10) Patent No.: US 6,299,977 B1
(45) Date of Patent: Oct. 9, 2001

(54) NON-WOVEN FABRIC AND ARTIFICIAL LEATHER

(75) Inventors: Naohiko Takeyama; Masahisa Mimura, both of Shimane (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 09/297,293

(22) PCT Filed: Aug. 28, 1998

(86) PCT No.: PCT/JP98/03846

§ 371 Date: Apr. 27, 1999

§ 102(e) Date: Apr. 27, 1999

(87) PCT Pub. No.: WO99/11853

PCT Pub. Date: Mar. 11, 1999

(30) Foreign Application Priority Data

Aug. 29, 1997 (JP) ..... 9-234477

(51) Int. Cl.[7] ..... D02G 3/00

(52) U.S. Cl. ..... 428/373; 428/904; 428/334; 428/335; 428/340; 442/340; 442/350; 442/351; 264/175

(58) Field of Search ..... 428/904, 373, 428/334, 335, 340; 442/350, 351, 340; 264/175

(56) References Cited

U.S. PATENT DOCUMENTS 3,932,687 * 1/1976 Okamoto et al. ..... 428/288
4,145,468 * 3/1979 Mizoguchi et al. ..... 428/239

FOREIGN PATENT DOCUMENTS

| | | |
|---|---|---|
| A 51-58578 | 5/1976 | (JP) . |
| A 53-56301 | 5/1978 | (JP) . |
| A 4-8547 | 2/1986 | (JP) . |
| A 62-42075 | 9/1987 | (JP) . |
| A 62-42076 | 9/1987 | (JP) . |
| A 6-33577 | 3/1988 | (JP) . |
| A 2-234979 | 9/1990 | (JP) . |
| A 3-161576 | 7/1991 | (JP) . |
| A 4-1326280 | 5/1992 | (JP) . |
| A 4-185777 | 7/1992 | (JP) . |
| A 7-133592 | 5/1995 | (JP) . |

OTHER PUBLICATIONS

International Search Report.

* cited by examiner

*Primary Examiner*—Elizabeth M. Cole
*Assistant Examiner*—Norca L. Torres
(74) *Attorney, Agent, or Firm*—Sughrue, Mion, Zinn, Macpeak & Seas, PLLC

(57) ABSTRACT

The present invention relates to a nonwoven fabric exhibiting dense, delicate, high quality appearance, and also relates to man made leathers exhibiting dense, delicate, high quality appearance, and bearing a resemblance to high quality natural leathers.

7 Claims, 4 Drawing Sheets

(1)

(2)

NON-WOVEN FABRIC AND ARTIFICIAL LEATHER

TECHNICAL FIELD

The present invention relates to a nonwoven fabric exhibiting dense, delicate, high quality appearance, more particularly relates to a nonwoven fabric suited for forming man made leathers. The present invention also relates to man made leathers exhibiting dense, delicate, high quality appearance, and bearing a resemblance to high quality natural leathers, especially relates to a nubuck-like man made leather.

BACKGROUND ART

Suede-like man made leathers having long naps, nubuck-like man made leathers having short naps, full grain type man made leathers having no nap, grain type nubuck-like man made leathers partially having short naps and the like are cited as main types of man made leathers in these years. These man made leathers are formed mainly by using nonwoven fabrics, and various proposals have been made for making these man made leathers bearing a resemblance in appearance as closely as possible to high quality natural leathers.

For example, in nubuck-like man made leathers, Japanese Patent Publication No. 62-42076 describes a process for producing a sheet-shaped material having naps consisting of ultrafine fibers wherein the base material is impregnated or coated with a resin to immobilize the naps, subsequently the napped surface is pressed by a calender roll to make the naps lie closely on the surface, and then the surface is buffed to raise naps. Japanese Patent Publication No. 62-42075 describes a process for producing a sheet-shaped material having naps consisting of ultrafine fibers wherein the napped surface is pressed by a calender roll to make the naps lie closely on the surface, and subsequently, the base material is impregnated or coated with a resin, and then the surface is buffed to raise naps. Japanese Patent Publication No. 6-33577 describes a process wherein an elastomeric polymer is applied on a fibrous sheet which comprises an ultrafine fiber-entangled nonwoven fabric having a single fineness of no greater than 0.3 de and containing the elastomeric polymer in it, the sheet is optionally embossed and buffed, and subsequently the sheet is subjected to an area contraction of 10% or more so that napped parts and grained parts are mixed in the surface. Japanese Unexamined Patent Publication No. 3-161576 describes a process for producing a nonwoven fabric comprising fibers convertible into ultrafine fibers wherein the fibers only in the surface layer are made ultrafine at first, then the nonwoven fabric is impregnated with an elastomeric resin, the resin is coagulated, subsequently the nonwoven fabric is treated under conditions that the fibers in the inner part of the nonwoven fabric are extracted with a solvent or the like to make them ultrafine, and then the outermost surface is napped. Further, Japanese Unexamined Patent Publication No. 4-136280 describes a process wherein a liquid of a composition containing non-fibrous collagen powder having an average particle diameter of no greater than 10 $\mu$m and an apparent density of 0.1–0.3 g/cm$^3$, and a polymer composed mainly of polyurethane is applied on the surface of a fibrous sheet comprising a fiber assembly containing a polymer composed mainly of an elastomeric polymer; the fiber sheet is subjected to an emboss processing; and subsequently the embossed coated surface is treated for raising naps. Further, Japanese Unexamined Patent Publication No. 7-133592 describes a process wherein on the surface of a fibrous base layer having smooth surface which comprises entangled nonwoven fabric comprising ultrafine fibers and/or ultrafine-fiber bundles and dense foamed bodies of an elastomeric polymer existing in entanglement spaces, is formed ultrafine naps which continue to ultrafine fibers that constitute the fibrous base layer; subsequently a resin composed mainly of an elastomeric polymer is applied on the napped surface to form a porous layer which is integrated with the naps; and further this is subjected to a napping treatment to make a part of the ultrafine naps be exposed on the surface of the sheet.

Nubuck-like man made leathers produced according to the conventional processes have short naps, and their surfaces are smooth; however, the quantities of fibers on the surfaces are extremely smaller than those of natural leathers, and larger parts of the surface are occupied not by napped parts consisting of ultrafine fibers but by resin parts consisting of elastomeric polymer and space parts. Thus, a nubuck-like man made leather having sharp writing effect attributable to extremely high nap density as in natural leathers, and exhibiting sticking soft-and-smooth touch while giving a dry feeling has not been proposed yet.

As for full grain type man made leathers, Japanese Patent Publication No. 4-8547 describes a process for producing a porous sheet material by wet coagulation of a polymer solution composed mainly of a polyurethane elastomer with a coagulant solution wherein to the coagulant solution is added an ethylene oxide adduct of at least one compound selected from higher alkyl amines, higher alcohols, sorbitan fatty acid esters and others; and a polymer solution free from the ethylene oxide adduct is coagulated by using the resulting coagulant solution. The full grain type man made leather which is produced by this process is excellent in smoothness of the surface; however, spaces between wrinkles formed on the man made leather when it is bent are larger than spaces between fine wrinkles formed on a natural leather, and the man made leather has high repulsion attributable to its homogeneous sponge-structure and exhibits a rubber-like feeling. Further, Japanese Unexamined Patent Publication No. 4-185777 describes a full grain type man made leather that is composed of a base layer comprising a nonwoven fabric which comprises ultrafine-fiber bundles and microporous urethane binder, and has a weight ratio of the ultrafine fiber bundles to the polyurethane of 70/30 to 97/3 and an apparent density of 0.5–0.8 g/cm$^3$, and a resin-made nonporous layer having a modulus of 20–150 kg/cm$^2$ at 100% elongation and a thickness of 10–100 $\mu$m. A full grain type man made leather produced by this process has a low repulsion and a good fine wrinkle feeling on bending, but its flexibility is not sufficient in spite of the application of a softening processing on it because the man made leather is constituted with a nonwoven fabric having such a high apparent density as 0.45 g/cm$^3$ or more. Thus, in full grain type man made leathers produced according to the conventional processes, man made leathers which are satisfactory in all of the properties that are characteristics to natural leathers, such as soft feeling, low repulsion, extremely smooth surface and very delicate fine wrinkle feeling on bending have not been achieved yet.

The object of the present invention, therefore, is to provide man made leathers having dense, delicate, high quality appearance, which are not obtained in conventional man made leathers, and bearing a resemblance to high quality natural leathers: for example, nubuck-like man made leathers having high class image of nubuck appearance characteristic of natural leathers, i.e. having sharp writing effect and exhibiting sticking soft-and-smooth touch while giving a dry feeling; grain type nubuck-like man made leathers having unique surface feeling; and full grain type man made leathers excellent in flexibility and surface smoothness, and exhibiting a delicate fine wrinkle feeling.

DISCLOSURE OF THE INVENTION

The inventors of the present invention have pursued extensive investigations for providing man made leathers having dense, delicate, high quality appearance and bearing a resemblance to high class natural leathers in each type of man made leathers, and accomplished their tasks to provide objective nonwoven fabrics, man made leathers and methods for producing them, which are described in the following 1 to 7.

1. A nonwoven fabric comprising ultrafine-fiber bundles having a single fineness of no greater than 0.2 de and/or fibers convertible into ultrafine-fiber bundles having a single fineness of no greater than 0.2 de, wherein the nonwoven fabric is characterized in that the minor diameters a and the major diameters b of the cross-sections of the ultrafine-fiber bundles and/or the fibers convertible into ultrafine-fiber bundles present on at least one side of the surfaces of the nonwoven fabric are in the range satisfying the following equation (1).

$$0.1 \leqq a/b \leqq 0.6 \quad (1)$$

2. A nubuck-like man made leather, wherein the nubuck-like man made leather is characterized in that a nonwoven fabric which constitutes the man made leather comprises ultrafine-fiber bundles having a single fineness of no greater than 0.2 de, and the minor diameters a and the major diameters b of the fiber bundle cross-sections of the ultrafine-fiber bundles present on at least one side of the surfaces of the nonwoven fabric are in the range satisfying the following equation (1).

$$0.1 \leqq a/b \leqq 0.6 \quad (1)$$

3. A method for producing a nubuck-like man made leather, wherein the production method is characterized in that at least one side of the surfaces of the nonwoven fabric comprising ultrafine-fiber bundles having a single fineness of no greater than 0.2 de and/or fibers convertible into ultrafine-fiber bundles having a single fineness of no greater than 0.2 de is pressed under conditions that the minor diameters a and the major diameters b of the cross-sections of the above-mentioned ultrafine-fiber bundles and/or fibers convertible into ultrafine-fiber bundles present on the surface of the nonwoven fabric in the product satisfy the following equation (1).

$$0.1 \leqq a/b \leqq 0.6 \quad (1)$$

4. A grain type nubuck-like man made leather, wherein the grain type nubuck-like man made leather is characterized in that a nonwoven fabric which constitutes the man made leather comprises ultrafine-fiber bundles having a single fineness of no greater than 0.2 de, and the minor diameters a and the major diameters b of the fiber bundle cross-sections of the ultrafine-fiber bundles present on at least one side of the surfaces of the nonwoven fabric are in the range satisfying the following equation (1).

$$0.1 \leqq a/b \leqq 0.6 \quad (1)$$

5. A method for producing a grain type nubuck-like man made leather, wherein the production method is characterized in that at least one side of the surfaces of the nonwoven fabric comprising ultrafine-fiber bundles having a single fineness of no greater than 0.2 de and/or fibers convertible into ultrafine-fiber bundles having a single fineness of no greater than 0.2 de is pressed under conditions that the minor diameters a and the major diameters b of the cross-sections of the above-mentioned ultrafine-fiber bundles and/or fibers convertible into ultrafine-fiber bundles present on the surface of the nonwoven fabric in the product satisfy the following equation (1).

$$0.1 \leqq a/b \leqq 0.6 \quad (1)$$

6. A full grain type man made leather, wherein the full grain type man made leather is characterized in that a nonwoven fabric which constitutes the man made leather comprises ultrafine-fiber bundles having a single fineness of no greater than 0.2 de, and the minor diameters a and the major diameters b of the fiber bundle cross-sections of the ultrafine-fiber bundles present on at least one side of the surfaces of the nonwoven fabric are in the range satisfying the following equation (1).

$$0.1 \leqq a/b \leqq 0.6 \quad (1)$$

7. A method for producing a full grain type man made leather, wherein the production method is characterized in that at least one side of the surfaces of the nonwoven fabric comprising ultrafine-fiber bundles having a single fineness of no greater than 0.2 de and/or fibers convertible into ultrafine-fiber bundles having a single fineness of no greater than 0.2 de is pressed under conditions that the minor diameters a and the major diameters b of the cross-sections of the above-mentioned ultrafine-fiber bundles and/or fibers convertible into ultrafine-fiber bundles present on the surface of the nonwoven fabric in the product satisfy the following equation (1).

$$0.1 \leqq a/b \leqq 0.6 \quad (1)$$

BEST MODE FOR CARRYING OUT THE INVENTION

Figure 1:
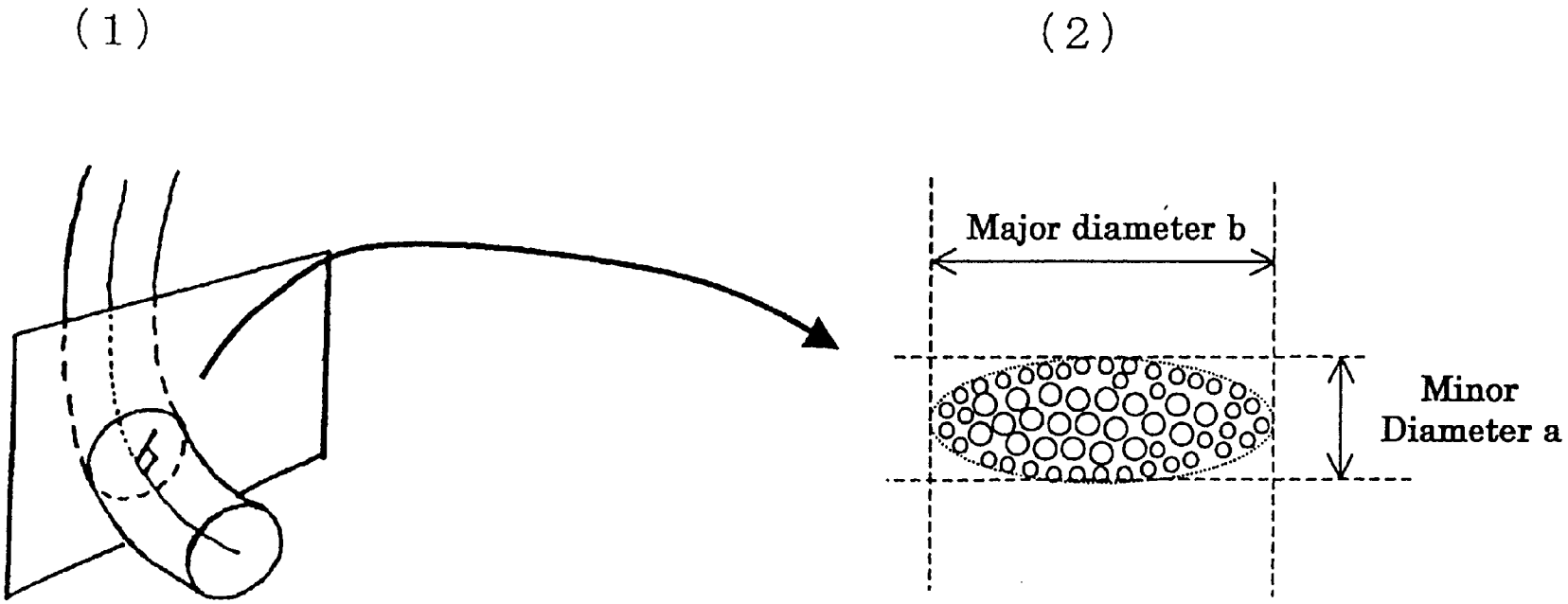
FIG. 1 represents schematic diagrams consisting of a drawing (1) showing a cutting direction (at right angles to the fiber axis direction) of an ultrafine-fiber bundle and a drawing (2) showing the minimum value (the minor diameter a) and the maximum value (the major diameter b) of the circumscribed ellips which inscribes as a whole the outermost ultrafine fibers of an ultrafine-fiber bundle.
Figure 2:
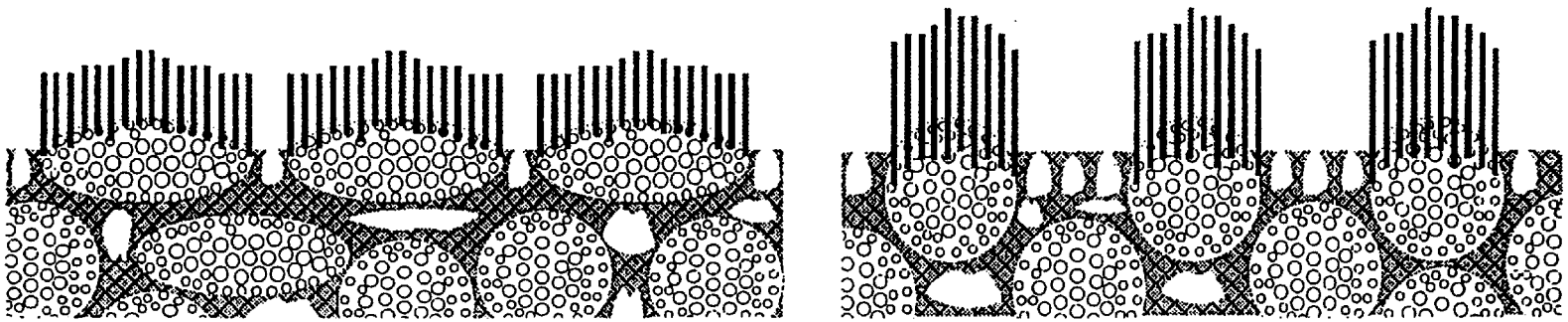
FIG. 2 (1) is the surface schematic diagram of a cross-section of a nubuck-like man made leather obtained in Example 1, and FIG. 2 (2) is the surface schematic diagram of a cross-section of a conventional nubuck-like man made leather whose ratio a/b is larger than 0.6.
Figure 3:
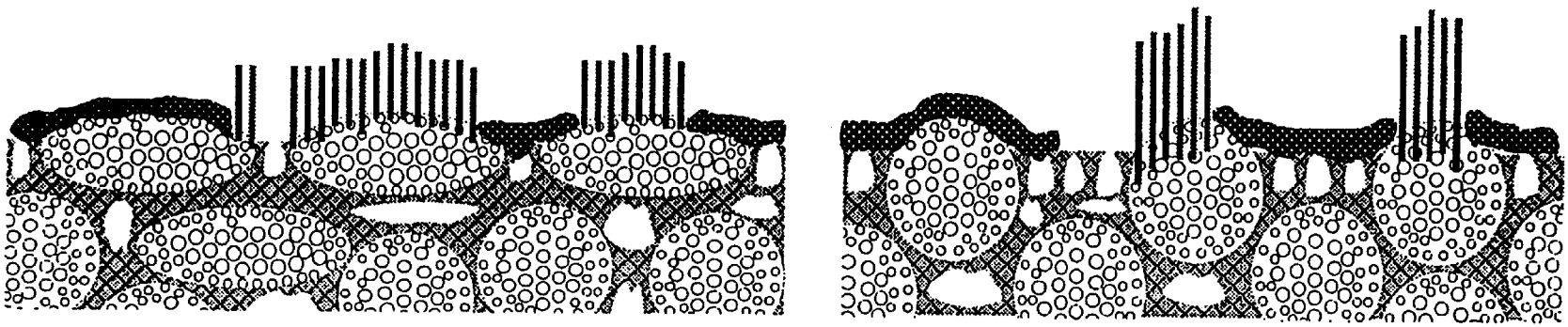
FIG. 3 (1) is the surface schematic diagram of a cross-section of a grain type nubuck-like man made leather obtained in Example 3, and FIG. 3 (2) is the surface schematic diagram of a cross-section of a conventional grain type nubuck-like man made leather whose ratio a/b is larger than 0.6.
Figure 4:
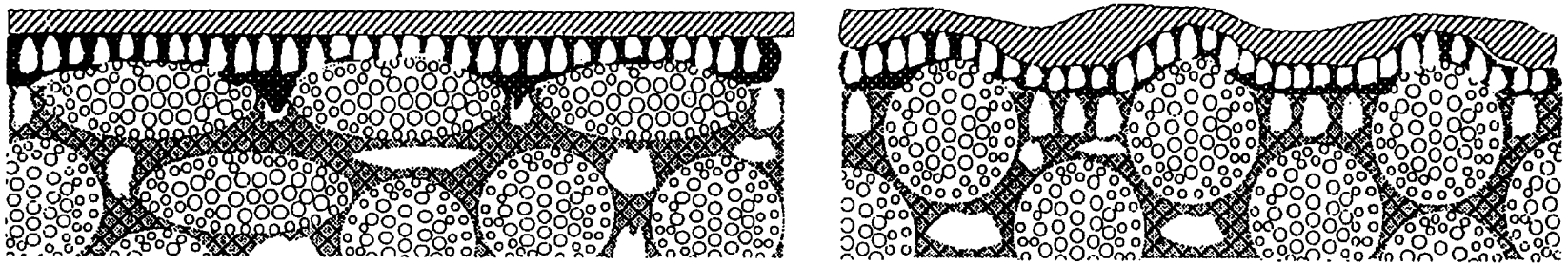
FIG. 4 (1) is the surface schematic diagram of a cross-section of a full grain type man made leather obtained in Example 4, and FIG. 4 (2) is the surface schematic diagram of a cross-section of a conventional full grain type man made leather whose ratio a/b is larger than 0.6.

Hereafter, the present invention will be explained in detail.

Nonwoven fabrics of the present invention comprise ultrafine-fiber bundles having a single fineness of no greater than 0.2 de. Examples of a high molecular polymer which forms the ultrafine fibers of the ultrafine-fiber bundles include polyamides such as nylon 6, nylon 66 and nylon 12, and polyesters such as polyethylene terephthalate and polybutylene terephthalate. Single fineness of the ultrafine fibers is no greater than 0.2 de, preferably no greater than 0.1 de. The single fineness used here may be referred to an average single fineness. The ultrafine fibers must be used in the form of bundles, and one bundle contains preferably 10–1000 of ultrafine fibers, further preferably 20–700.

In a nonwoven fabric comprising the ultrafine-fiber bundles, the minor diameters a and the major diameters b of the cross-sections of the ultrafine-fiber bundles and/or the fibers convertible into ultrafine-fiber bundles present on at least one side of the surfaces of the nonwoven fabric must be in the range satisfying the following equation (1).

$$0.1 \leqq a/b \leqq 0.6 \quad (1)$$

Herein, the value a/b can be smaller than 0.1, but it is difficult to make the value a/b on the surface of the nonwoven fabric smaller than 0.1 from the point of view of processability. On the other hand, when the value a/b is larger than 0.6, the quantity of fibers covering the surface of the nonwoven fabric becomes small, and the appearance of a man made leather made of such nonwoven fabric is poor in surface smoothness, and unfavorably resembles to a conventional man made leather in its appearance.

The term "at least one side of the surfaces of a nonwoven fabric" used in the present invention means one side or both sides of the surfaces of the nonwoven fabric. The term "surface" means the layers from the surface layer to the fifth layer, preferably to the third layer of a nonwoven fabric comprising an ultrafine-fiber bundle. "The minor diameter a and the major diameter b of a cross-section of an ultrafine-fiber bundle and/or a fiber convertible into an ultrafine-fiber bundle" are as shown in FIG. 1. Herein, "a fiber bundle cross-section of an ultrafine-fiber bundle" is the circumscribed ellipse which inscribes as a whole the outermost ultrafine fibers of an ultrafine-fiber bundle which is cut at right angles to the fiber axis direction of the ultrafine-fiber bundle. "The minor diameter a and the major diameter b of a fiber-bundle cross-section of an ultrafine-fiber bundle" are the minimum value and the maximum value of the diameters of the circumscribed ellipse, respectively. Further, "the cross-section of a fiber convertible into an ultrafine-fiber bundle" is an elliptic cross-section of a fiber convertible into an ultrafine-fiber bundle which is cut at right angles to the fiber axis direction of the fiber, and "the minor diameter a and the major diameter b of a cross-section of a fiber convertible into an ultrafine-fiber bundle" are the minimum value and the maximum value of the diameters of said elliptic cross-section, respectively. In nonwoven fabrics of the present invention, the value of the a/b can be determined by cutting arbitrarily a nonwoven fabric which has been treated by a pressing process, selecting ultrafine-fiber bundles which have been cut at right angles to the fiber-axis direction from the bundles at the surface of the nonwoven fabric on the cross-section, and determining the values of the a/b from magnified photographs of the cross-sections of the selected bundles.

Further, checking whether a nonwoven fabric constituting a certain man made leather satisfies the criteria of a nonwoven fabric of the present invention also can be carried out by cutting the man made leather arbitrarily, selecting bundles which have been cut at right angles to the fiber-axis direction from the ultrafine-fiber bundles at the surface of the nonwoven fabric on the cross-section and determining the values of a/b from magnified photographs of the cross-sections of the selected bundles.

In a nubuck-like man made leather of the present invention, the nonwoven fabric constituting the man made leather comprises ultrafine-fiber bundles having a single fineness of no greater than 0.2 de. As for the high molecular polymer which forms the ultrafine fibers and the single fineness of the ultrafine fibers, the same kinds of polymers and the same range of fineness as in the case of the above-mentioned nonwoven fabric can be used.

In nonwoven fabrics comprising the ultrafine-fiber bundles, the minor diameter a and the major diameter b of the fiber-bundle cross-section of an ultrafine-fiber bundle present on at least one side of the surfaces must be in the range satisfying the following equation (1).

$$0.1 \leqq a/b \leqq 0.6 \quad (1)$$

Herein, the value a/b can be smaller than 0.1, but it is difficult to make the value of a/b at the surface of the nonwoven fabric smaller than 0.1 from the point of view of processability. Further, when the value a/b is larger than 0.6, the quantity of fibers covering the surface of a nonwoven fabric becomes small, and the nap density of the obtained man made leather becomes unfavorably low.

The term "at least one side of the surfaces of a nonwoven fabric" means one side or both sides of the surfaces of a nonwoven fabric constituting a man made leather. The term "surface" means the layers from the surface layer of a nonwoven fabric to the fifth layer, preferably to the third layer of an ultrafine-fiber bundle in the nonwoven fabric constituting a man made leather. "The minor diameter a and the major diameter b of a fiber-bundle cross-section of an ultrafine-fiber bundle" are as shown in FIG. 1. Herein, "a fiber bundle cross-section of an ultrafine-fiber bundle" is the circumscribed ellips which inscribes as a whole the outermost ultrafine fibers of an ultrafine-fiber bundle which is cut at right angles to the fiber axis direction of the ultrafine-fiber bundle, and "the minor diameter a and the major diameter b of a fiber-bundle cross-section of an ultrafine-fiber bundle" are the minimum value and the maximum value of the diameters of the circumscribed ellips, respectively. In the production of a nubuck-like man made leather of the present invention, the value of the a/b can be determined by cutting arbitrarily a nonwoven fabric which has been treated by a pressing process, selecting ultrafine-fiber bundles which have been cut at right angles to the fiber-axis direction from the bundles at the surface of the nonwoven fabric on the cross-section, and determining the value of the a/b from magnified photographs of the cross-sections of the selected bundles.

Further, the checking whether a certain nubuck-like man made leather satisfies the criteria of a nubuck-like man made leather of the present invention also can be carried out by cutting the nubuck-like man made leather arbitrarily, selecting bundles which have been cut at right angles to the fiber-axis direction from the ultrafine-fiber bundles at the surface of the nonwoven fabric on the cross-section and determining the values of a/b from magnified photographs of the cross-sections of the selected bundles.

Production of a nubuck-like man made leather can be achieved by pressing at least one surface of a nonwoven fabric comprising ultrafine-fiber bundles having a single fineness of no greater than 0.2 de and/or fibers convertible into ultrafine-fiber bundles having a single fineness of no greater than 0.2 de under conditions where the minor diameters a and the major diameters b of the cross-sections of the ultrafine-fiber bundles and/or the fibers convertible into ultrafine-fiber bundles present at the surface of the nonwoven fabric in the product satisfy the following equation (1).

$$0.1 \leqq a/b \leqq 0.6 \quad (1)$$

Herein, "a fiber convertible into an ultrafine-fiber bundle having a single fineness of no greater than 0.2 de" means a fiber which can be converted into an ultrafine-fiber bundle having a single-fineness of no greater than 0.2 de by an after-treatment such as a solvent treatment or a splitting treatment. Examples of the fiber convertible into an ultrafine-fiber bundle include a composite fiber comprising multi components of high molecular polymers. As the forms of the composite fiber, for example, an islands-in-a-sea type, a side-by-side type and the like can be cited, and the island-in-a-sea type is preferred. Besides the above-mentioned polyamide and polyester, polyethylene, polypropylene, a high-molecular weight polyethylene glycol, polystyrene, polyacrylate and the like can be used as the high molecular polymers of the composite fibers.

A nubuck-like man made leather of the present invention is produced by pressing at least one side of the surfaces of a nonwoven fabric comprising the above-mentioned ultrafine-fiber bundles and/or fibers convertible into ultrafine-fiber bundles under conditions where the minor diameters a and the major diameters b of the cross-sections of the ultrafine-fiber bundles and/or fibers convertible into ultrafine-fiber bundles present at the surface(s) of the nonwoven fabric in the product satisfy the above-mentioned equation (1). The pressing process is carried out, for example, by a nipping treatment using a calender roll, or a pressing treatment using an embossing machine, a plain board press or a roll press. As for a timing of the pressing treatment in the production of a nubuck-like man made leather, there is no special restriction as far as it is carried out, for example, after the impregnation of the nonwoven fabric with a high molecular elastomeric polymer (A), the coagulation of the elastomeric polymer (A) or the like, and before the buffing treatment on the base material of the man made leather; but it is preferable that the pressing treatment is carried out after the nonwoven fabric has been impregnated with the high molecular elastomeric polymer (A) from the view point of the manufacturing processability of the man made leather. When a nonwoven fabric comprising fibers convertible into ultrafine-fiber bundles is used, it is preferable that the pressing treatment is carried out after the nonwoven fabric has been impregnated with the high molecular elastomeric polymer (A) and before the fibers convertible into ultrafine-fiber bundles are treated for the conversion.

Hereafter, methods for producing nubuck-like man made leathers of the present invention will be explained with concrete examples.

Fibers convertible into ultrafine-fiber bundles, which are islands-in-a-sea type composite fibers, are processed to form a web by using a conventionally known machine such as a card, a random webber or a cross-layer. Needle-punching is applied on the obtained web in the direction of the thickness preferably at a barb-penetration punching density of 500–3000 punches/cm$^2$, particularly preferably of 800–2000 punches/cm$^2$ to entangle the fibers convertible into ultrafine-fiber bundles to form a nonwoven fabric. When the barb-penetration punching density is less than 500 punches/cm$^2$, the entanglement of the nonwoven fabric is insufficient, and the strength of the nonwoven fabric is poor. It is not preferable to use such a nonwoven fabric for the production of a nubuck-like man made leather since the obtained nubuck-like man made leather is insufficient in a writing effect. Further, when the barb-penetration punching density is more than 3000 punches/cm$^2$, punching is unfavorably excessive since the entangled fibers suffer from great damage and a yielding phenomenon occurs in the obtained nonwoven fabric. The term "barb-penetration punching density" as used herein means the number of punches per cm$^2$ which are performed in the direction of thickness of a web, by using a needle having at least one barb, at the depth in which the front barb penetrates the web. It is preferable that the obtained nonwoven fabric is heated to soften the sea component of the composite fiber, and subsequently the nonwoven fabric is pressed with a calender roll or the like to adjust the thickness, apparent density and surface smoothness. This adjustment can be carried out properly depending on the use of the objective man made leather. It is however preferable that the resulting nonwoven fabric has, for example, the thickness of 0.4–3.0 mm, the apparent density of 0.25–0.45 g/cm$^3$ and flat surfaces. Herein, the pressing with a heated calender roll is especially preferable since the heat treatment and the press treatment can be applied simultaneously.

Thus obtained nonwoven fabric is impregnated with a solution or dispersion of a high molecular elastomeric polymer (A), and the polymer is coagulated to produce a base material. Examples of the high molecular elastomeric polymer (A) used here include polyurethane elastomer, polyurea elastomer, polyurethane polyurea elastomer, polyacrylic acid resin, acrylonitrile butadiene elastomer and styrene butadiene elastomer. Among them, polyurethane group elastomers such as polyurethane elastomer, polyurea elastomer and polyurea-polyurethane elastomer are preferable. These polyurethane elastomers are obtained by reacting one kind, or two or more kinds of polymeric glycols selected from polyether glycols, polyester glycols, polyester-ether glycols, polycaprolactone glycols, polycarbonate glycols and the like having average molecular weight of 500 to 4000 with an organic diisocyanate such as 4,4'-diphenylmethane diisocyanate, xylylene diisocyanate, tolylene diisocyanate, dicyclohexylmethane diisocyanate or isophorone diisocyanate, and a chain extender selected from low molecular glycols, diamines, hydrazine derivatives such as hydrazine, organic acid hydrazides and amino acid hydrazides, and the like.

The impregnation of the above-mentioned high molecular elastomeric polymer (A) into a nonwoven fabric is generally carried out using a solution or dispersion (including aqueous emulsion) of the high molecular elastomeric polymer (A) in an organic solvent. Here, as the solution containing a solvent for the high molecular elastomeric polymer (A), it is preferable to use a solution comprising a good solvent for the high molecular elastomeric polymer (A) such as dimethylformamide, diethylformamide, dimethylacetamide or tetrahydrofuran, or a solution prepared by adding water, an alcohol, methyl ethyl ketone or the like to the solution, or a solution prepared further by adding the high molecular elastomeric polymer (A) to this solution. The solution containing a solvent for the high molecular elastomeric polymer (A) preferably contains a solvent for the high molecular elastomeric polymer (A) at least 50% or more, more preferably 70% or more because a part of the above-mentioned high molecular elastomeric polymer (A) must be dissolved or swelled. The concentration of the high molecular elastomeric polymer (A) to be impregnated is preferably 8–20%, especially preferably 12–18% from view points of softness of a produced nubuck-like man made leather, and denseness, napping fiber density and the like of the surface of the nubuck-like man made leather. When the concentration is lower than 8%, the produced nubuck-like man made leather has soft feeling, but the feeling of naps of the surface is rough, and it is poor in the nubuck-like appearance. On the other hand, when the concentration is higher than 20%, the appearance is improved in denseness, and the napping resembles nubuck-like napping having short fibers; however, it has a shortcoming of hard feeling. The amount of the high molecular elastomeric polymer (A) to be impregnated is preferably in the range of 15–80% of the weight of the nonwoven fabric after the treatment for converting the constituting fibers into ultrafine fibers.

The above obtained base material is preferably squeezed to 60–95% of its thickness, more preferably to 65–90%. When the squeeze ratio is less than 60%, the amount of the high molecular elastomeric polymer (A) contained in the base material is too small, and the nubuck-like man made leather produced from the base material has napping-fibers of long inhomogeneous lengths. When the squeeze ratio is larger than 95%, the surface of a final sheet becomes resin-like, and the objective nubuck-like man made leather of the present invention is hardly obtained. The setting of the squeeze ratio in the above range enables the obtaining of a nubuck-like man made leather having high napping density and excellent in the homogeneity of the napping state.

Subsequently, the impregnated high molecular elastomeric polymer (A) is coagulated in the base material. A method for coagulating the high molecular elastomeric polymer (A) may be any one selected from known wet-type coagulation methods and dry-type coagulation methods, but it is preferable to select a method which coagulates the high molecular elastomeric polymer (A) in the base material into a porous state. Further, a thin coating layer of a high molecular elastomeric polymer (B), which is same kind as or different kind from the impregnated high molecular elastomeric polymer (A), is optionally placed on the surface of the base material.

The film-coated base material is pressed between a planished metal roll heated at 140–200° C. and a backup roll (robber roll), or between a pair of planished metal rolls heated at 140–200° C. with a base material-pressing pressure (inter-roll pressure) of 10 kg/cm to 35 kg/cm to bring the value a/b of the surface of the nonwoven fabric in the range of the equation (1). Although it depends on the use of the obtained nubuck-like man made leather, the pressing treatment for adjusting the value a/b of the surface of the nonwoven fabric in the range of the equation (1) is applied either on one side or both sides of the base material. Further, it is possible that the pressing treatment is applied on the both sides of the base material, and the pressed base material is sliced in the direction of the thickness into two sheets before use.

After these processes, at least one of the high molecular polymers of the composite fibers constituting the base material is dissolved and removed by extraction to convert the composite fibers into ultrafine-fiber bundles. As the nonwoven fabric-constituting fibers, it is preferable to use composite fibers from a processing advantage, that is, when the composite fibers are used as the nonwoven fabric-constituting fibers, the composite fibers can be converted into ultrafine fibers, concurrently forming ultrafine-fiber bundles. In the case where the high molecular polymer to be removed by a solvent is a polyamide, a mixed liquid of an alkali metal or an alkaline earth metal and a lower alcohol, formic acid or the like can be used as the removing agent. In the case of a polyester, an effective solvent is an alkali aqueous solution of sodium hydroxide, potassium hydroxide or the like. In the case of polyethylene, polystyrene, polyacrylate or the like, an effective solvent is benzene, toluene or xylene.

Subsequently, a solution containing solvent(s) for the high molecular elastomeric polymer(s) (A) and/or (B) is applied on the surface of the base material whose fibers have been converted into ultrafine fibers. The method for coating is not specifically restricted, any known method being applicable. For example, the solution can be applied by using a gravure coater or a spray coater. In this process, the solution is applied preferably while the base material is lightly nipped with the gravure roll or the like. After the coating, the product is subjected to a solvent-removing treatment for removing the solvent from the coated solution containing solvent(s) for the high molecular elastomeric polymer(s) (A) and/or (B) to solidify the polymer(s). As the solvent-removing treatment, a dry method using a hot air dryer, a wet method immersing into a liquid such as water, or the like can be used; however, it is preferable to use a dry method since the amount of use of the solution containing solvent(s) for the high molecular elastomeric polymer(s) (A) and/or (B) is reducible. Further, the process comprising the application of the solution and the removal of the solvent is preferably repeated at least 2–6 times, and the more the repetition is, the more the homogeneity of the surface of a nubuck-like man made leather which is finally obtained is improved; however, it is unfavorable to repeat the process more than 6 times since the surface tends to become hard. Preferable amount of the solution to be added to a non-napped surface of the base material is 5–100 g/m$^2$. When the amount of the solution added is less than 5 g/m$^2$, the napping fibers on the surface of the finally obtained nubuck-like man made leather tend to become longer, and the objective nubuck-like man made leather is hardly produced. On the other hand, when it exceeds 100 g/m$^2$, the surface of the finally obtained nubuck-like man made leather becomes hard, and thereby the solvent removing process needs longer time.

The surface of the base material which has been treated for converting the fibers into ultrafine fibers and further furnished with a solution containing solvent(s) for the high molecular elastomeric polymer(s) (A) and/or (B) is subjected to a buffing treatment to form a napped surface. The buffing treatment can be performed by using a sand paper, a sand cloth, a sand net, a sand roll, a brush, a grindstone, a needle cloth or the like; however, for obtaining very short, nubuck-like naps, it is preferable to use a sand paper. Further, a sand paper having fine grits is preferable, and light buffing is also preferable. If strong buffing is applied by using a sand paper having coarse grits, the surface gets rough, and the objective man made leather having a nubuck-like appearance is hardly obtained. The application of a solution containing solvent(s) for the high molecular elastomeric polymer(s) (A) and/or (B) on a buffed surface is not preferable, because in the finally obtained nubuck-like man made leather, the amount of napped fibers covering the surface is small, the state of napping is inhomogeneous, and further the napping density on the surface is low.

Further, in the manufacturing process for a nubuck-like man made leather of the present invention, common processes such as dyeing processing, softening processing by rubbing, etc., and/or finishing processing using other functioning agents such as a softener or a water repellent are optionally applied on arbitrary stages.

Grain type nubuck-like man made leather of the present invention is a man made leather having napped parts consisting of ultrafine fiber naps having single fineness of no greater than 0.2 de, and grain surface parts composed of a composite layer consisting of ultrafine fibers having single fineness of no greater than 0.2 de which are fixed with a high molecular elastomeric polymer (C) on the surface of a man made leather. Further, the lengths of the naps in the napping part are 40–300 $\mu$m; the area of the grain surface parts is 5–80% of the total surface area; and the majority of the grain surface parts comprises discrete layers of 0.05–100 $mm^2$ in area. A nonwoven fabric constituting the grain type nubuck-like man made leather comprises ultrafine-fiber bundles having single fineness of no greater than 0.2 de. As for the high molecular polymer which forms the ultrafine fibers and the single fineness of the ultrafine fibers, the same kinds of polymers and the same range of fineness as in the case of the above-mentioned nonwoven fabric can be used.

In nonwoven fabrics comprising the ultrafine-fiber bundles, the minor diameter a and the major diameter b of the fiber-bundle cross-section of an ultrafine-fiber bundle present on at least one side of the surfaces must be in the range satisfying the following equation (1).

$$0.1 \leqq a/b \leqq 0.6 \quad (1)$$

Herein, the value a/b can be smaller than 0.1, but it is difficult to make the value of a/b at the surface of the nonwoven fabric smaller than 0.1 from the point of view of processability. Further, it is unfavorable to make the value a/b larger than 0.6, because it makes the quantity of fibers covering the surface of a nonwoven fabric small, the nap density in the napping part of the obtained grain type nubuck-like man made leather low, the surface smoothness in the grain surface part poor, and wrinkles that are formed on it when it is bent too large.

The term "at least one side of the surfaces of a nonwoven fabric" means one side or both sides of the surfaces of the nonwoven fabric constituting a man made leather. The term "surface" means the layers from the surface layer of a nonwoven fabric to the fifth layer, preferably to the third layer of an ultrafine-fiber bundle in the nonwoven fabric constituting a man made leather. "The minor diameter a and the major diameter b of a fiber-bundle cross-section of an ultrafine-fiber bundle" are as shown in FIG. 1. Herein, "a fiber bundle cross-section of an ultrafine-fiber bundle" is the circumscribed ellips which inscribes as a whole the outermost ultrafine fibers of an ultrafine-fiber bundle which is cut at right angles to the fiber axis direction of the ultrafine-fiber bundle, and "the minor diameter a and the major diameter b of a fiber-bundle cross-section of an ultrafine-fiber bundle" are the minimum value and the maximum value of the diameters of the circumscribed ellips, respectively. In the production of a grain type nubuck-like man made leather of the present invention, the value of the a/b can be determined by cutting arbitrarily a nonwoven fabric which has been treated by a pressing process, selecting ultrafine-fiber bundles which have been cut at right angles to the fiber-axis direction from the bundles at the surface of the nonwoven fabric on the cross-section, and determining the value of the a/b from magnified photographs of the cross-sections of the selected bundles.

Further, the checking whether a certain grain type nubuck-like man made leather satisfies the criteria of a grain type nubuck-like man made leather of the present invention also can be carried out by cutting the grain type nubuck-like man made leather arbitrarily, selecting bundles which have been cut at right angles to the fiber-axis direction from the ultrafine-fiber bundles at the surface of the nonwoven fabric on the cross-section and determining the values of a/b from magnified photographs of the cross-sections of the selected bundles.

Production of a grain type nubuck-like man made leather can be achieved by pressing at least one surface of a nonwoven fabric comprising ultrafine-fiber bundles having a single fineness of no greater than 0.2 de and/or fibers convertible into ultrafine-fiber bundles having a single fineness of no greater than 0.2 de under conditions where the minor diameters a and the major diameters b of the cross-sections of the ultrafine-fiber bundles and/or the fibers convertible into ultrafine-fiber bundles present at the surface of the nonwoven fabric in the product satisfy the following equation (1).

$$0.1 \leqq a/b \leqq 0.6 \quad (1)$$

Herein, "a fiber convertible into an ultrafine-fiber bundle having a single fineness of no greater than 0.2 de" means a fiber which can be converted into an ultrafine-fiber bundle having a single-fineness of no greater than 0.2 de by an after-treatment such as a solvent treatment or a splitting treatment. Examples of the fiber convertible into an ultrafine-fiber bundle include a composite fiber comprising multi components of high molecular polymers. As the forms of the composite fiber, for example, an islands-in-a-sea type, a side-by-side type or the like can be cited, and the island-in-a-sea type is preferred. Besides the above-mentioned polyamide and polyester, polyethylene, polypropylene, a high-molecular weight polyethylene glycol, polystyrene, polyacrylate and the like can be used as the high molecular polymers of the composite fibers.

A grain type nubuck-like man made leather of the present invention is produced by pressing at least one side of the surfaces of a nonwoven fabric comprising the above-mentioned ultrafine-fiber bundles and/or fibers convertible into ultrafine-fiber bundles under conditions where the minor diameters a and the major diameters b of the cross-sections of the ultrafine-fiber bundles and/or fibers convertible into ultrafine-fiber bundles present at the surface(s) of the nonwoven fabric satisfy the above-mentioned equation (1). The pressing process is carried out, for example, by a nipping treatment using a calender roll, or a pressing treatment using an embossing machine, a plain board press or a roll press. As for a timing of the pressing treatment in the production of a grain type nubuck-like man made leather, there is no special restriction as far as it is carried out, for example, after the impregnation of the nonwoven fabric with a high molecular elastomeric polymer (A), the coagulation of the elastomeric polymer (A) or the like, and before the buffing treatment on the base material of the man made leather and before the formation of the grain surface parts comprising the high molecular elastomeric polymer (C); but it is preferable that the pressing treatment is carried out after the nonwoven fabric has been impregnated with the high molecular elastomeric polymer (A) from the view point of manufacturing processability of the man made leather. When a nonwoven fabric comprising fibers convertible into ultrafine-fiber bundles is used, it is preferable that the pressing treatment is carried out after the nonwoven fabric has been impregnated with the high molecular elastomeric polymer (A) and before the fibers convertible into ultrafine-fiber bundles is treated for the conversion.

Hereafter, methods for producing grain type nubuck-like man made leathers of the present invention are explained with concrete examples.

Fibers convertible into ultrafine-fiber bundles, which are islands-in-a-sea type composite fibers, are processed to form a web by using a conventionally known machine such as a card, a random webber or a cross-layer. Needle-punching is applied on the obtained web in the direction of the thickness preferably at a barb-penetration punching density of 500–3000 punches/cm$^2$, particularly preferably of 800–2000 punches/cm$^2$ to entangle the fibers convertible into ultrafine-fiber bundles to form a nonwoven fabric. When the barb-penetration punching density is less than 500 punches/cm$^2$, the entanglement of the nonwoven fabric is insufficient, and the strength of the nonwoven fabric is poor. It is not preferable to use such a nonwoven fabrics for the production of a grain type nubuck-like man made leather since the obtained grain type nubuck-like man made leather is insufficient in a writing effect. Further, when the barb-penetration punching density is more than 3000 punches/cm$^2$, punching is unfavorably excessive since the entangled fibers suffer from great damage, and a yielding phenomenon occurs in the obtained nonwoven fabric. The term "barb-penetration punching density" as used herein means the number of punches per cm$^2$ which are performed in the direction of thickness of a web, by using a needle having at least one barb, at the depth in which the front barb penetrates the web. It is preferable that the obtained nonwoven fabric is heated to soften the sea component of the composite fiber, and subsequently the nonwoven fabric is pressed with a calender roll or the like to adjust the thickness, apparent density and surface smoothness. This adjustment can be carried out properly depending on the use of the objective man made leather. It is however preferable that the resulting nonwoven fabric has, for example, the thickness of 0.4–3.0 mm, the apparent density of 0.25–0.45 g/cm$^3$ and flat surfaces. Herein, the pressing with a heated calender roll is especially preferable since the heat treatment and the press treatment can be applied simultaneously.

Thus obtained nonwoven fabric is impregnated with a solution or dispersion of a high molecular elastomeric polymer (A), and the polymer is coagulated to produce a base material. Examples of the high molecular elastomeric polymer (A) used here include polyurethane elastomer, polyurea elastomer, polyurethane polyurea elastomer, polyacrylic acid resin, acrylonitrile butadiene elastomer and styrene butadiene elastomer. Among them, polyurethane group elastomers such as polyurethane elastomer, polyurea elastomer and polyurea-polyurethane elastomer are preferable. These polyurethane elastomers are obtained by reacting one kind, or two or more kinds of polymeric glycols selected from polyether glycols, polyester glycols, polyester-ether glycols, polycaprolactone glycols, polycarbonate glycols and the like having average molecular weight of 500–4000 with an organic diisocyanate such as 4,4'-diphenylmethane diisocyanate, xylylene diisocyanate, tolylene diisocyanate, dicyclohexylmethane diisocyanate and isophorone diisocyanate, and a chain extender selected from low molecular glycols, diamines, hydrazine derivatives such as hydrazine, organic acid hydrazides and amino acid hydrazides, and the like.

The impregnation of the above-mentioned high molecular elastomeric polymer (A) into a nonwoven fabric is generally carried out using a solution or dispersion (including aqueous emulsion) of the high molecular elastomeric polymer (A) in an organic solvent. Here, as the solution containing a solvent for the high molecular elastomeric polymer (A), it is preferable to use a solution comprising a good solvent for the high molecular elastomeric polymer (A) such as dimethylformamide, diethylformamide, dimethylacetamide or tetrahydrofuran, or a solution prepared by adding water, an alcohol, methyl ethyl ketone or the like to the solution, or a solution prepared further by adding the high molecular elastomeric polymer (A) to this solution. The solutions of the high molecular elastomeric polymer (A) containing a solvent preferably contains a solvent for the high molecular elastomeric polymer (A) at least 50% or more, more preferably 70% or more because a part of the above-mentioned high molecular elastomeric polymer (A) must be dissolved or swelled. The concentration of the high molecular elastomeric polymer (A) to be impregnated is preferably 8–20%, especially preferably 12–18% from view points of softness of a produced grain type nubuck-like man made leather, and denseness, napping fiber density and the like of the surface of the grain type nubuck-like man made leather. When the concentration is lower than 8%, the produced grain type nubuck-like man made leather has soft feeling, but the feeling of naps of the surface is rough, and it is poor in the grain type nubuck-like appearance. On the other hand, when the concentration is higher than 20%, the appearance is improved in denseness, and the napping resembles grain type nubuck-like napping having short staple length; however, it has a shortcoming of hard feeling. The amount of the high molecular elastomeric polymer (A) to be impregnated is preferably in the range of 15–80% of the weight of the nonwoven fabric after the constituting fibers convertible into ultrafine-fiber bundles have been treated for the conversion The above obtained base material is preferably squeezed to 60–95% of its thickness, more preferably to 65–90%. When the squeeze ratio is less than 60%, the amount of the high molecular elastomeric polymer (A) contained in the base material is too small, and the grain type nubuck-like man made leather produced from the base material has napping fibers of long inhomogeneous lengths. When the squeeze ratio is larger than 95%, the surface of a final sheet becomes resin-like, and the objective grain type nubuck-like man made leather of the present invention is hardly obtained. The setting of the squeeze ratio in the above range enables the obtaining of a grain type nubuck-like man made leather having high napping density and excellent in the homogeneity of the napping state.

Subsequently, the impregnated high molecular elastomeric polymer (A) is coagulated in the base material. A method for coagulating the high molecular elastomeric polymer (A) may be any one selected from known wet-type coagulation methods and dry-type coagulation methods, but it is preferable to select a method which can coagulate the high molecular elastomeric polymer (A) in the base material into a porous state. Further, a thin coating layer of a high molecular elastomeric polymer (B), which is same kind as or different kind from the impregnated high molecular elastomeric polymer (A), is optionally placed on the surface of the base material.

The film-coated base material is pressed between a planished metal roll heated at 140–200° C. and a backup roll (robber roll), or between a pair of planished metal rolls heated at 140–200° C. with a base material-pressing pressure (inter-roll pressure) of 10 kg/cm to 35 kg/cm to bring the value a/b of the surface of the nonwoven fabric in the range of the equation (1). Although it depends on the use of the obtained grain type nubuck-like man made leather, the pressing treatment for adjusting the value a/b of the surface of the nonwoven fabric in the range of the equation (1) is applied either on one side or both sides of the base material. Further, it is possible that the pressing treatment is applied on the both sides of the base material, and the pressed base material is sliced in the direction of the thickness into two sheets before use.

After these processes, at least one of the high molecular polymers of the composite fibers constituting the base material is dissolved and removed by extraction to convert the composite fibers into ultrafine-fiber bundles. As the nonwoven fabric-constituting fibers, it is preferable to use composite fibers from a processing advantage, that is, when the composite fibers are used as the nonwoven fabric-constituting fibers, the composite fibers can be converted into ultrafine fibers, concurrently forming ultrafine-fiber bundles. In the case where the high molecular polymer to be removed by a solvent is a polyamide, a mixed liquid of an alkali metal or an alkaline earth metal and a lower alcohol, formic acid or the like can be used as the removing agent. In the case of a polyester, an effective solvent is an alkali aqueous solution of sodium hydroxide, potassium hydroxide or the like. In the case of polyethylene, polystyrene, polyacrylate or the like, an effective solvent is benzene, toluene or xylene.

Following conversion into ultrafine fiber, a grain type nubuck-like man made leather of the present invention can be produced by a conventionally known method.

A representative processing method comprises the application of the solution containing solvent(s) for the high molecular elastomeric polymer(s) (A) and/or (B) on the surface of the base material whose fibers have been converted into ultrafine fibers. This method for coating is not specifically restricted, any known method being applicable. For example, the solution can be applied by using a gravure coater or a spray coater. In this process, the solution is preferably applied while the base material is lightly nipped with the gravure roll or the like. After the coating, the product is subjected to a solvent-removing treatment for removing the solvent from the coated solution containing solvent(s) for the high molecular elastomeric polymer(s) (A) and/or (B) to solidify the high molecular elastomeric polymer (A) and/or (B). As the solvent-removing treatment, a dry method using a hot air dryer, a wet method immersing into a liquid such as water, or the like can be used; however, it is preferable to use a dry method since the amount of use of the solution containing solvent(s) for the high molecular elastomeric polymer(s) (A) and/or (B) is reducible. Further, the process comprising the application of the solution and the removal of the solvent is preferably repeated at least 2–6 times, and the more the repetition is, the more the homogeneity of the surface of a grain type nubuck-like man made leather which is finally obtained is improved; however, it is unfavorable to repeat the process more than 6 times since the surface tends to become hard. Preferable amount of the solution to be added to a non-napped surface of the base material is 5–100 g/m$^2$. When the amount of the solution added is less than 5 g/m$^2$, the napping fibers on the surface of the finally obtained grain type nubuck-like man made leather tend to become longer, and the objective grain type nubuck-like man made leather is. hardly produced. On the other hand, when it exceeds 100 g/m$^2$, the surface of the finally obtained grain type nubuck-like man made leather becomes hard, and thereby the solvent removing process needs longer time.

The surface of the base material which has been treated for converting the fibers into ultrafine fibers and further furnished with a solution containing solvent(s) for the high molecular elastomeric polymer(s) (A) and/or (B) is subjected to a buffing treatment to form a napped surface. The buffing treatment can be performed by using a sand paper, a sand cloth, a sand net, a sand roll, a brush, a grindstone, a needle cloth or the like; however, for obtaining very short, grain type nubuck-like naps, it is preferable to use a sand paper. Further, a sand paper having fine grits is preferable, and light buffing is also preferable. If strong buffing is applied by using a sand paper having coarse grits, the surface gets rough, and the objective man made leather having a nubuck-like appearance is hardly obtained. The application of a solution containing solvent(s) for the high molecular elastomeric polymer(s) (A) and/or (B) on a buffed surface is not preferable, because in the finally obtained grain type nubuck-like man made leather, the quantity of napped fibers covering the surface is small, the state of napping is inhomogeneous, and further the napping density on the surface is low. A high molecular elastomeric polymer (C) same as or different from the high molecular elastomeric polymer (A) or (B) is further applied in such a state that the area of the grain surface parts occupies 5–80% of the total surface area of the man made leather that has been obtained in the above-mentioned process, and most of the grain surface parts become discrete layers of 0.05–100 mm$^2$ in area. The grain surface parts comprising composite layers in which ultrafine fibers having single fineness of no greater than 0.2 de are fixed with the high molecular elastomeric polymer (C) is formed to obtain a grain type nubuck-like man made leather. The application of the high molecular elastomeric polymer (C) may be performed by a known method. For example, the high molecular elastomeric polymer (C) may be applied by using a print roll; or protrusions and recesses are formed by embossing, and the high molecular elastomeric polymer (C) is applied on the protrusions by using a gravure coater. However, the method is not limited to these ones. The area of the coating is in the range of 5–80%, preferably 10–50% of the total surface area of a base material. When it is smaller than 5%, not only the design created from the grain surface becomes poor, but also the quantity of fibers exposed on the surface is too large, and objective grain type nubuck-like appearance is hardly obtained. On the other hand, when it is larger than 80%, writing effect characteristic to nubuck-like man made leathers can not be produced, and the surface has stiff hard feeling. Further, it is important that the grain surface layer is formed in such a state that most of the grain surface parts becomes discrete layers of 0.05–100 mm$^2$, preferably 0.1–20 mm$^2$ in area. When each coating area of the high molecular elastomeric polymer (C) is less than 0.05 mm$^2$, the properties as grain surface, gloss feeling and abrasion resistance becomes insufficient. On the other hand, when it is larger than 100 mm$^2$, the writing effect is weakened, and grain type nubuck-like appearance is hardly obtained. The "area" used herein means a projected area in the normal direction of surface of the base material.

Furthermore, in the manufacturing process for a grain type nubuck-like man made leather of the present invention, common processes such as dyeing processing, softening processing by rubbing, etc., and/or finishing processing using other functioning agents such as a softener or a water repellent are optionally applied on arbitrary stages. The softening processing by rubbing, etc., for enhancing the writing effect of napped parts is preferably performed after the application of the high molecular elastomeric polymer (C).

Full grain type man made leather of the present invention is a man made leather having a grain surface layer consisting of a high molecular elastomeric polymer (D) at least one side of the surfaces, and the nonwoven fabric constituting the man made leather comprises ultrafine-fiber bundles having single fineness of no greater than 0.2 de. As for the high molecular polymer which forms the ultrafine fibers and the single fineness of the ultrafine fibers, the same kinds of polymers and the same range of fineness as in the case of the above-mentioned nonwoven fabric can be used.

In nonwoven fabrics comprising the ultrafine-fiber bundles, the minor diameter a and the major diameter b of the fiber-bundle cross-section of an ultrafine-fiber bundle present on at least one side of the surfaces must be in the range satisfying the following equation (1).

$$0.1 \leqq a/b \leqq 0.6 \quad (1)$$

It is further preferable that they are in the range satisfying the following equation (2), since a full grain type man made leather having soft excellent surface smoothness and delicate fine wrinkle feeling can be obtained by using such a nonwoven fabric.

$$0.1 \leqq a/b \leqq 0.5 \quad (2)$$

Herein, the value a/b can be smaller than 0.1, but it is difficult to make the value of a/b at the surface of the nonwoven fabric smaller than 0.1 from the point of view of processability. Further, when the value a/b is larger than 0.6, the surface smoothness in the grained surface is poor and wrinkles that are formed on it when it is bent are unfavorably large.

The term "at least one side of the surfaces of a nonwoven fabric" means one side or both sides of the surfaces of the nonwoven fabric constituting a man made leather. The term "surface" means, at the side where a grained layer exists in the full grain type man made leather, the layers from the surface layer of a nonwoven fabric to the fifth layer, preferably to the third layer of an ultrafine-fiber bundle in the nonwoven fabric constituting the man made leather. "The minor diameter a and the major diameter b of a fiber-bundle cross-section of an ultrafine-fiber bundle" are as shown in FIG. 1. Herein, "a fiber bundle cross-section of an ultrafine-fiber bundle" is the circumscribed ellips which inscribes as a whole the outermost ultrafine fibers of an ultrafine-fiber bundle which is cut at right angles to the fiber axis direction of the ultrafine-fiber bundle, and "the minor diameter a and the major diameter b of a fiber-bundle cross-section of an ultrafine-fiber bundle" are the minimum value and the maximum value of the diameters of the circumscribed ellips, respectively. In the production of a full grain type man made leather of the present invention, the value of the a/b can be determined by cutting arbitrarily a nonwoven fabric which has been treated by a pressing process, selecting ultrafine-fiber bundles which have been cut at right angles to the fiber-axis direction from the bundles at the surface of the nonwoven fabric on the cross-section, and determining the value of the a/b from magnified photographs of the cross-sections of the selected bundles.

Further, the checking whether a certain full grain type man made leather satisfies the criteria of a full grain type man made leather of the present invention also can be carried out by cutting the full grain type man made leather arbitrarily, selecting of bundles which have been cut at right angle to the fiber-axis direction from the bundles at the surface of the nonwoven fabric on the cross section and determining the values of a/b from magnified photographs of the cross-sections of the selected bundles.

Production of a full grain type man made leather can be achieved by pressing at least one surface of a nonwoven fabric comprising ultrafine-fiber bundles having a single fineness of no greater than 0.2 de and/or fibers convertible into ultrafine-fiber bundles having a single fineness of no greater than 0.2 de under conditions where the minor diameters a and the major diameters b of the cross-sections of the ultrafine-fiber bundles and/or the fibers convertible into ultrafine-fiber bundles present at the surface of the nonwoven fabric in a product satisfy the following equation (1), $$0.1 \leqq a/b \leqq 0.6 \quad (1)$$

and further preferably satisfy the following equation (2).

$$0.1 \leqq a/b \leqq 0.5 \quad (2)$$

Herein, "a fiber convertible into an ultrafine-fiber bundle having a single fineness of no greater than 0.2 de" means a fiber which can be converted into an ultrafine-fiber bundle having a single-fineness of no greater than 0.2 de by an after-treatment such as a solvent treatment or a splitting treatment. Examples of the fiber convertible into an ultrafine-fiber bundle include a composite fiber comprising multi components of high molecular polymers. As the forms of the composite fiber, for example, an islands-in-a-sea type, a side-by-side type or the like can be cited, and the island-in-a-sea type is preferred. Besides the above-mentioned polyamide and polyester, polyethylene, polypropylene, a high-molecular weight polyethylene glycol, polystyrene, polyacrylate and the like can be used as the high molecular polymers of the composite fibers.

A full grain type man made leather of the present invention is produced by pressing at least one side of the surfaces of a nonwoven fabric comprising the above-mentioned ultrafine-fiber bundles and/or fibers convertible into ultrafine-fiber bundles under conditions where the minor diameters a and the major diameters b of the cross-sections of the ultrafine-fiber bundles and/or fibers convertible into ultrafine-fiber bundles present at the surface(s) of the nonwoven fabric in the product satisfy the above-mentioned equation (1), and further preferably satisfy the above-mentioned equation (2). The pressing process can be carried out, for example, by a nipping treatment using a calender roll, or a pressing treatment using an embossing machine, a plain board press or a roll press. As for a timing of the pressing treatment in the production of a full grain type man made leather, there is no special restriction as far as it is carried out, for example, after the impregnation of the nonwoven fabric with a high molecular elastomeric polymer (A), the coagulation of the elastomeric polymer (A) or the like, and before the buffing treatment on the base material of the man made leather and before the formation of the grain surface layers comprising the high molecular elastomeric polymer (D); but it is preferable that the pressing treatment is carried out after the nonwoven fabric has been impregnated with the high molecular elastomeric polymer (A) from the view point of manufacturing processability of the man made leather. When a nonwoven fabric comprising fibers convertible into ultrafine-fiber bundles is used, it is preferable that the pressing treatment is carried out after the nonwoven fabric has been impregnated with the high molecular elastomeric polymer (A) and before the fibers convertible into ultrafine-fiber bundles are treated for the conversion.

A full grain type man made leather of the present invention can be produced either of the following method, that is, a nonwoven fabric of the preset invention is impregnated with the high molecular elastomeric polymer (A), and further a high molecular elastomeric polymer (D), which is a same kind as or a different kind from the high molecular elastomeric polymer (A) which has been impregnated on the surface, is continuously applied; or the high molecular elastomeric polymer (D) is applied on the surface of a nubuck-like man made leather of the present invention or a base material of the nubuck-like man made leather on which napped surfaces are not formed yet.

Hereafter, a typical manufacturing method among them will be explained with concrete examples.

Fibers convertible into ultrafine-fiber bundles, which are islands-in-a-sea type composite fibers, are processed to form a web by using a conventionally known machine such as a card, a random webber or a cross-layer. Needle-punching is applied on the obtained web in the direction of the thickness preferably at a barb-penetration punching density of 500–3000 punches/cm$^2$, particularly preferably of 800–2000 punches/cm$^2$ to entangle the fibers convertible into ultrafine-fiber bundles to form a nonwoven fabric. When the barb-penetration punching density is less than 500 punches/cm$^2$, the entanglement of the nonwoven fabric is insufficient, and the strength of the nonwoven fabric is poor. It is not preferable to use such a nonwoven fabric for the production of a full grain type man made leather since the obtained full grain type man made leather is insufficient in strength. Further, when the barb-penetration punching density is more than 3000 punches/cm$^2$, punching is unfavorably excessive since the entangled fibers suffer from great damage and a yielding phenomenon occurs in the obtained nonwoven fabric. The term "barb-penetration punching density" as used herein means the number of punches per cm$^2$ which are performed in the direction of thickness of a web, by using a needle having at least one barb, at the depth in which the front barb penetrates the web. It is preferable that the obtained nonwoven fabric is heated to soften the sea component of the composite fiber, and subsequently the nonwoven fabric is pressed with a calender roll or the like to adjust the thickness, apparent density and surface smoothness. This adjustment can be carried out properly depending on the use of the objective man made leather. It is however preferable that the resulting nonwoven fabric has, for example, the thickness of 0.4–3.0 mm, the apparent density of 0.25–0.45 g/cm$^3$ and flat surfaces. Herein, the pressing with a heated calender roll is especially preferable since the heat treatment and the press treatment can be applied simultaneously.

Thus obtained nonwoven fabric is impregnated with a solution or dispersion of a high molecular elastomeric polymer (A), and the polymer is coagulated to produce a base material. Examples of the high molecular elastomeric polymer (A) used here include polyurethane elastomer, polyurea elastomer, polyurethane-polyurea elastomer, polyacrylic acid resin, acrylonitrile butadiene elastomer and styrene butadiene elastomer. Among them, polyurethane group elastomers such as a polyurethane elastomer, polyurea elastomer and polyurea-polyurethane elastomer are preferable. These polyurethane elastomers are obtained by reacting one kind, or two or more kinds of polymeric glycols selected from polyether glycols, polyester glycols, polyester-ether glycols, polycaprolactone glycols, polycarbonate glycols and the like having average molecular weight of 500–4000 with an organic diisocyanate such as 4,4'-diphenylmethane diisocyanate, xylylene diisocyanate, tolylene diisocyanate, dicyclohexylmethane diisocyanate and isophorone diisocyanate, and a chain extender selected from low molecular glycols, diamines, hydrazine derivatives such as hydrazine, organic acid hydrazides and amino acid hydrazides, and the like.

The impregnation of the above-mentioned high molecular elastomeric polymer (A) into a nonwoven fabric is generally carried out using a solution or dispersion (including aqueous emulsion) of the high molecular elastomeric polymer (A) in an organic solvent. Here, as the solution containing a solvent for the high molecular elastomeric polymer (A), it is preferable to use a solution comprising a good solvent for the high molecular elastomeric polymer (A) such as dimethylformamide, diethylformamide, dimethylacetamide or tetrahydrofuran, or a solution prepared by adding water, an alcohol, methyl ethyl ketone or the like to the solution, or a solution prepared further by adding the high molecular elastomeric polymer (A) to this solution. The solution containing a solvent for the high molecular elastomeric polymer (A) preferably contains a solvent for the high molecular elastomeric polymer (A) at least 50% or more, more preferably 70% or more because a part of the above-mentioned high molecular elastomeric polymer (A) must be dissolved or swelled. The concentration of the high molecular elastomeric polymer (A) to be impregnated is preferably 8–20%, especially preferably 12–18% from view points of softness of a produced full grain type man made leather, and denseness, napping fiber density and the like of the surface of the full grain type man made leather. When the concentration is lower than 8%, the produced full grain type man made leather has soft feeling, but the smoothness of the surface becomes poor and full grain type appearance will be hardly obtained. On the other hand, when the concentration exceeds 20%, the smoothness of the surface is improved, and delicate fine wrinkles appear on bending; however, it has a shortcoming of hard feeling. The amount of the high molecular elastomeric polymer (A) to be impregnated is preferably in the range of 15–80% of the weight of the nonwoven fabric after the treatment for converting the constituting fibers into ultrafine fibers.

The above obtained base material is preferably squeezed to 60–95% of its thickness, more preferably to 65–90%. When the squeeze ratio is less than 60%, the amount of the high molecular elastomeric polymer (A) contained in the base material is too small, and the full grain type man made leather produced from the base material is poor in surface smoothness and homogeneity. When the squeeze ratio is larger than 95%, the surface of a final sheet becomes resin-like, and the objective full grain type man made leather of the present invention is hardly obtained. The setting of the squeeze ratio in the above range enables the obtaining of a full grain type man made leather having high surface smoothness and delicate fine wrinkle feeling.

Subsequently, the impregnated high molecular elastomeric polymer (A) is coagulated in the base material. A method for coagulating the high molecular elastomeric polymer (A) may be any one selected from known wet-type coagulation methods and dry-type coagulation methods, but it is preferable to select a process which can coagulate the high molecular elastomeric polymer (A) in the base material into a porous state. Further, a thin coating layer of a high molecular elastomeric polymer (B), which is same kind as or different kind from the impregnated high molecular elastomeric polymer (A), is optionally placed on the surface of the base material.

The film-coated base material is pressed between a planished metal roll heated at 140–200° C. and a backup roll (robber roll), or between a pair of planished metal rolls heated at 140–200° C. with a base material-pressing pressure (inter-roll pressure) of 10 kg/cm to 35 kg/cm to bring the value a/b of the surface of the nonwoven fabric in the range of the equation (1), preferably in the range of the equation (2). Although it depends on the use of the obtained full grain type man made leather, the pressing treatment for adjusting the value a/b of the surface of the nonwoven fabric in the range of the equation (1) is applied either on one side or both sides of the base material. Further, it is possible that the pressing treatment is applied on the both sides of the base material, and the pressed base material is sliced in the direction of the thickness into two sheets before use.

After these processes, at least one of the high molecular polymers of the composite fibers constituting the base material is dissolved and removed by extraction to convert the composite fibers into ultrafine-fiber bundles. The use of composite fibers as the nonwoven fabric-constituting fibers is preferable. This is attributable to the manufacturing advantages, that is, the composite fibers can be converted into ultrafine fibers, concurrently forming ultrafine-fiber bundles. In the case where the high molecular polymer to be removed by a solvent is a polyamide, a mixed liquid of an alkali metal or an alkaline earth metal and a lower alcohol, formic acid or the like can be used as the removing agent. In the case of a polyester, an effective solvent is an alkali aqueous solution of sodium hydroxide, potassium hydroxide or the like. In the case of polyethylene, polystyrene, polyacrylate or the like, an effective solvent is benzene, toluene or xylene.

Subsequently, the grain surface layer comprising a high molecular elastomeric polymer (D) which is same kind as or different kind from the impregnated high molecular elastomeric polymer (A) is placed on the surface of the base material whose fibers have been converted into ultrafine fibers. The grain surface layer placed may be porous layers or filled layers, or may consist of two or more resin layers.

Further, in the manufacturing process for a full grain type man made leather of the present invention, common processes such as dyeing process, softening process by rubbing, etc., and/or finishing process using other functioning agents such as a softener or a water repellent are optionally applied on arbitrary stages.

EXAMPLES

The present invention will be explained further in detail hereafter with examples, while the present invention is not restricted by the examples. In the example, %, parts and ratios are by weight as far as they are not otherwise specified.

Example 1

Nylon 6 (the island component) and a low-density polyethylene (the sea component) were mixed spun at a 50/50 ratio to obtain islands-in-a-sea composite fibers having fineness of 8.0 de. The obtained composite fibers were cut into staple fibers having a cut-length of 51 mm. This was converted into web by using a card and a cross layer. The web was needle punched at a punching density of 1400 punches/cm$^2$ and subjected to a heat treatment in a hot air chamber at 150° C. The needle punched web was pressed with a calender roll at 30° C. before it got cool to obtain a nonwoven fabric having a unit area weight of about 570 g/m$^2$, a thickness of 1.6 mm and an apparent density of 0.36 g/cm$^3$.

The obtained nonwoven fabric was impregnated with a solution (concentration:15%) in dimethyl formamide (DMF) of a polyurethane elastomer that was obtained by reacting a polybutylene adipate having a molecular weight of 1800, a polytetramethylene ether glycol having a molecular weight of 2050, 4,4-diphenylmethane diisocyanate and ethylene glycol, and exhibited a nitrogen content of 4.5% originated from the isocyanate, and then immersed into a 15% DMF aqueous solution to coagulate the elastomer. The nonwoven fabric was sufficiently washed in hot water of 40° C. and dried in a hot air chamber at 135° C. to obtain a high molecular elastomeric polymer-impregnated base material.

The surface of the obtained base material was pressed at a base material-compressing pressure (inter roll pressure) of 22 kg/cm by using a smooth planished metal roll heated at 175° C. and a cold backup roll.

The base material was then repeatedly subjected to a dipping/nipping treatment in toluene of 80° C. to dissolve the polyethylene component to remove it from the composite fibers, and thereby the composite fibers were converted into ultrafine fibers. The toluene contained in the base material was removed by azeotropic distillation in water at 90° C., and the base material was dried in a hot air chamber at 120° C. The obtained ultrafine fibers had an average single fineness of 0.004 de and the number of the ultrafine fibers in an ultrafine-fiber bundle was 635.

DMF was applied on the smooth planished metal roll-treated surface of the base material at a ratio of 9 g/m$^2$ by using a gravure coater having a 200 mesh size and dried by heating. The coating/drying process was repeated four times, and the surface part of the cross-section was examined under a microscope to determine the minor diameters a and the major diameters b of the fiber-bundle cross-sections of ultrafine-fiber bundles present at the surface of the nonwoven fabric, and it was revealed that the value of the a/b was 0.2. On one side of the surfaces of the base material, extremely light buffing for forming a napped surface was applied four times by using a sand paper having a 800 mesh size to obtain a nubuck-like man made leather.

Thus obtained nubuck-like man made leather was dyed under the following conditions.

| | |
|---|---|
| bathratio | 1:30 |
| dyestuff | 10% owf |
| dyestuff compounding ratio | |
| Lanasyn Yellow S-2GL (manufactured by Sandoz) | 7 |
| Kayalax Brown GR (manufactured by Nihon-Kayaku) | 3 |
| Lanasyn Red S-G (manufactured by Sandoz) | 2 |

After dyeing and drying, the man made leather was given a softener and a water repellent, and subjected to a rubbing processing.

The obtained nubuck-like man made leather exhibited an appearance of extremely high class image, i.e., having sharp writing effect, and exhibiting sticking soft-and-smooth touch while giving a dry feeling. The results are summarized in Table 1.

Comparative Example 1

Processes were carried out as in Example 1 except that the temperature of the smooth planished metal roll used in the pressing process was set at 100° C. The obtained nubuck-like man made leather had a value of the a/b of the fiber-bundle cross-sections of ultrafine-fiber bundles present at the surface of the nonwoven fabric of 0.7. Although the obtained nubuck-like man made leather exhibited the nubuck-like feature of short naps, it had a low nap density at the surface and was poor in sharpness of the writing effect. Further, the surface of the base material was not sufficiently covered with the naps, and the nubuck-like man made leather had an appearance short of high class image. The results are summarized in Table 1.

Example 2

As islands-in-a-sea composite fibers constituting a nonwoven fabric, staple fibers having a cut length of 51 mm was obtained by cutting composite filaments composed of polyethylene terephthalate (the island component) and a low-density polyethylene (the sea component) at a ratio of 60/40, and having an island number of 60 and a fineness of 5.0 de. This was processed into web by using a card and a cross layer. The web was needle punched at a punching density of 1200 punches/cm$^2$ and subjected to a heat treatment in a hot air chamber at 150° C. The needle punched web was pressed with a calender roll at 30° C. before it got cool to obtain a nonwoven fabric having a unit area weight of about 610 g/m$^2$, a thickness of 1.7 mm and an apparent density of 0.36 g/cm$^3$.

The obtained nonwoven fabric was impregnated with a solution (concentration: 15%) in DMF of a polyurethane elastomer that was prepared by reacting a polybutylene adipate having a molecular weight of 1800, a polytetramethylene ether glycol having a molecular weight of 2050, 4,4-diphenylmethane diisocyanate and ethylene glycol, and exhibited a nitrogen content of 4.5% originated from the isocyanate. Then, the web was immersed into a 15% DMF aqueous solution to coagulate the elastomer. The nonwoven fabric was sufficiently washed in hot water of 40° C. and dried in a hot air chamber at 135° C. to obtain a high molecular elastomeric polymer-impregnated base material.

The both surfaces of the obtained base material were pressed at a base material-compressing pressure (inter roll pressure) of 22 kg/cm between a pair of smooth planished metal rolls heated at 160° C.

The base material was then repeatedly subjected to a dipping/nipping treatment in toluene of 80° C. to dissolve the polyethylene component to remove it from the composite fibers, and thereby the composite fibers were converted into ultrafine fibers. The toluene contained in the base material was removed by azeotropic distillation in water at 90° C., and the base material was dried in a hot air chamber at 120° C. The obtained ultrafine fibers had an average single fineness of 0.05 de and the number of the ultrafine fibers in an ultrafine fiber bundle was 60.

DMF was applied on the surfaces of the base material at a ratio of 9 g/m$^2$ by using a gravure coater having a 200 mesh size and dried by heating. The coating/drying process was repeated four times, and the surface part of the cross-section was examined under a microscope. The value of the a/b of the fiber-bundle cross-sections of an ultrafine-fiber bundles present at the surface of the nonwoven fabric was 0.4.

On both surfaces of the treated base material, extremely light buffing was applied three times by using a sand paper having a 600 mesh size to form naps, and the nonwoven fabric was sliced in the direction of thickness into two sheets to obtain nubuck-like man made leathers.

Thus obtained nubuck-like man made leather was dyed under the following conditions.

| | |
|---|---|
| bath ratio | 1:30 |
| dyestuff | 8% owf |
| dyestuff compounding ratio | |
| Yellow (disperse dye) | 7.4 |
| Red (disperse dye) | 3.2 |
| Black (disperse dye) | 0.6 |

After dyeing and drying, the man made leather was given a softener and a water repellent, and subjected to a rubbing processing.

The obtained nubuck-like man made leather had an appearance of extremely high class image, i.e., having sharp writing effect, and exhibiting sticking soft-and-smooth touch while giving a dry feeling. The results are summarized in Table 1.

Comparative Example 2

As islands-in-a-sea composite fibers constituting a nonwoven fabric, staple fibers having a cut length of 51 mm was obtained by cutting composite filaments composed of polyethylene terephthalate (the island component) and a low-density polyethylene (the sea component) at a ratio of 50/50, and having an island number of 16 and a fineness of 12.0 de. This was processed into web by using a card and a cross layer. The web was needle punched at a punching density of 1200 punches/cm$^2$ and subjected to a heat treatment in a hot air chamber at 150° C. The needle punched web was pressed with a calender roll at 30° C. before it got cool to obtain a nonwoven fabric having a unit area weight of about 580 g/m$^2$, a thickness of 1.6 mm and an apparent density of 0.36 g/cm$^3$.

The nonwoven fabric was impregnated with a polyurethane elastomer solution (concentration:15%) in DMF, treated to coagulate the elastomer and washed as in Experiment 2 to obtain a high molecular elastomeric polymer-impregnated base material.

The both surfaces of the obtained base material were pressed at a base material-compressing pressure (inter roll pressure) of 22 kg/cm between a pair of smooth planished metal rolls heated at 160° C. The base material was then repeatedly subjected to a dipping/nipping treatment in toluene of 80° C. to dissolve the polyethylene component to remove it from the composite fiber, and thereby the composite fibers were converted into ultrafine fibers. The toluene contained in the base material was removed by azeotropic distillation in water at 90° C., and the base material was dried in a hot air chamber at 120° C. The obtained ultrafine fibers had an average single fineness of 0.4 de and the number of the ultrafine fibers in an ultrafine-fiber bundle was 16. Then, DMF was applied on the surfaces of the base material at a ratio of 9 g/m$^2$ by using a gravure coater having a 200 mesh size and dried by heating. The coating/drying process was repeated four times, and the cross-sections of the surfaces were examined under a microscope. The value of the a/b of the fiber-bundle cross-sections of an ultrafine-fiber bundles present at the surface of the nonwoven fabric was 0.3.

On both surfaces of the treated base material, extremely light buffing was applied three times by using a sand paper having a 600 mesh size to form naps, and the base material was sliced in the direction of thickness into two sheets to obtain nubuck-like man made leathers.

After they were subjected to dyeing and finishing processes as in Experiment 2, the obtained product had long naps and a different appearance from nubuck. Further, it had a very poor writing effect because of the large size (fineness) of the napped fibers. The results are summarized in Table 1.

Example 3

The surface of the nubuck-like man made leather obtained in Example 1 was subjected to a press processing by using an embossing roll heated at 180° C. and having a design which bares resemblance to pores of the skin of calf, at a base material-compressing pressure (inter roll pressure) of 22 kg/cm to form protrusions and recesses on the surface of the base material. A 10% solution of a polyurethane elastomer was applied at a coating ratio of 30 g/m$^2$ on the surface of the base material by using a gravure coater having a 75 mesh size with a clearance of 80% of the thickness of the base material between the roller and a backup roller, followed by drying. The coating/drying process was repeated four times to form grained surface layers only on the protrusions. This was further subjected to a rubbing processing. The obtained grain type nubuck-like man made leather had a high napping density, excellent writing effect and extremely high smoothness at the napped part, and was good in fine wrinkle feeling on bending at grained surface parts. The microscopic examination of the surface part of the cross-section of the grain type nubuck-like man made leather revealed that the value of the a/b of the fiber-bundle cross-section of an ultrafine-fiber bundle present at the surface of the nonwoven fabric was 0.5.

Comparative Example 3

Processes were carried out as in Example 3 except that the temperature of the smooth planished metal roll used in the pressing process was set at 100° C. The microscopic examination of the surface part of the cross-section of the obtained grain type nubuck-like man made leather revealed that the value of the a/b of the fiber-bundle cross-sections of an ultrafine-fiber bundles present at the surface was 0.7. The grain type nubuck-like man made leather was poor both in napping density at the napped part and in smoothness at grained surface parts, and further wrinkles formed on bending were unfavorably large at grained surface parts.

Example 4

The surface of the nubuck-like man made leather obtained in Example 1 was subjected to a press processing by using planished metal rolls at a base material-compressing pressure (inter roll pressure) of 22 kg/cm. Subsequently, a 10% solution of a polyurethane elastomer was applied at a coating ratio of 30 g/m$^2$ on the surface of the base material by using a gravure coater having a 75 mesh size with a clearance of 80% of the thickness of the base material between the roller and a backup roller, followed by drying. The coating/drying process was repeated four times. The microscopic examination of the surface part of the cross-section revealed that the value of the a/b of the fiber-bundle cross-sections of ultrafine-fiber bundles present on the surface was 0.5. The surface of the base material was subjected to a press processing by using an embossing roll heated at 180° C. and having a kangaroo-like design at a base material-compressing pressure (inter roll pressure) of 22 kg/cm to impart a natural leather-like design to the surface of the base material. Further, a finishing agent comprising a low modulus polyurethane elastomer having good surface feeling was applied on it by using a gravure coater having a 200 mesh size with a clearance of 40% of the thickness of the base material between the roller and a backup roller at a coating ratio of 10 g/m$^2$ of the polyurethane elastomer solution followed by hot air drying. The coating/drying process was repeated twice, and then rubbing process was performed to obtain a full grain type man made leather. The obtained full grain type man made leather had an extremely smooth full grain type surface, had fine wrinkles formed when it was bent and was excellent in softness.

Comparative Example 4

Nylon 6 (the island component) and a low-density polyethylene (the sea component) were mixed spun at 50/50 ratio to obtain islands-in-a-sea composite fibers having fineness of 8.0 de. The obtained composite fibers were cut into staple fibers having a cut-length of 51 mm. This was processed into web by using a card and a cross layer. The web was needle punched at a punching density of 1400 punches/cm$^2$ and subjected to a heat treatment in a hot air chamber at 150° C. The needle punched web was pressed with a calender roll at 30° C. before it got cool to obtain a nonwoven fabric of extremely high density having a unit area weight of about 870 g/m$^2$, a thickness of 1.7 mm and an apparent density of 0.51 g/cm$^3$.

When the same processing as Example 4 was carried out by using the obtained nonwoven fabric, the value of the a/b of the fiber-bundle cross-sections of an ultrafine-fiber bundles present at the surface was 0.4, and the value of the a/b of the fiber-bundle cross-section of an ultrafine-fiber bundle present in the inner part of the base material was 0.6. The obtained full grain type man made leather had an extremely smooth full grain type surface and formed delicate fine wrinkles on bending, and it exhibits very high quality. However, the density of the nonwoven fabric of the full grain type man made leather was high through out the all layers of the base material, and even after the softening processing by rubbing, the flexibility was insufficient.

INDUSTRIAL FIELD OF APPLICATION

As mentioned above, a nonwoven fabric of the present invention exhibits dense, delicate, high quality appearance, and is particularly suited for forming a man made leather. Further, man made leathers of the present invention exhibit dense, delicate, high quality appearance, and bear a resemblance to high quality natural leathers. Especially, a nubuck-like man made leather exhibits napping appearance having short, homogeneous, dense naps similar to the napping appearance of natural leathers, and because of such a napping appearance, the nubuck-like man made leather becomes a high quality nubuck-like man made leather having a sharp writing effect and exhibiting sticking soft-and-smooth touch while giving a dry feeling. Further, a grain type nubuck-like man made leather has a characteristic surface feeling, and a full grain type man made leather also is excellent both in flexibility and in surface smoothness, and at the same time exhibits a delicate fine wrinkle feeling.

TABLE 1

| | Example 1 | Comparative Example 1 | Example 2 | Comparative Example 2 |
|---|---|---|---|---|
| Average single fineness of ultrafine fiber (de) | 0.004 | 0.004 | 0.050 | 0.400 |
| Number of ultrafine fibers in fiberbundle | 635 | 635 | 60 | 16 |
| a/b | 0.2 | 0.7 | 0.4 | 0.3 |
| Nap density on the surface of nubuck-like artificial leather | high | low | high | low |
| Nap length on the surface of nubuck-like artificial leather | short | short | short | long |
| Homogeneity of the surface of nubuck-like artificial leather | good | not homogeneous | good | good |

TABLE 1-continued

| | Example 1 | Comparative Example 1 | Example 2 | Comparative Example 2 |
|---|---|---|---|---|
| Writing effect of the surface of nubuck-like artificial leather | sharp | poor | harp | very poor |
| Surface feeling of nubuck-like artificial leather | dense | rough | dense | rough |

What is claimed is:

1. A nonwoven fabric comprising ultrafine-fiber bundles having a single fineness of no greater than 0.2 de and/or fibers convertible into ultrafine-fiber bundles having a single fineness of no greater than 0.2 de, wherein the nonwoven fabric is characterized in that:

the cross-sections of the ultrafine-fiber bundles and/or the fibers convertible into ultrafine-fiber bundles present on at least one side of the surfaces of the nonwoven fabric are ellipses, the major diameters b of said cross-sections are parallel to a surface of the nonwoven fabric, and the minor diameters a and the major diameters b of said cross-sections are in the range satisfying the following equation (1)

$$0.1 \leqq a/b \leqq 0.6 \quad (1).$$

2. A nubuck man made leather, wherein the nubuck man made leather is characterized in that:

a nonwoven fabric which constitutes the man made leather comprises ultrafine-fiber bundles having a single fineness of no greater than 0.2 de, the cross-sections of the ultrafine-fiber bundles present on at least one side of the surfaces of the nonwoven fabric are ellipses, the major diameters b of said cross-sections are parallel to a surface of the nonwoven fabric, and the minor diameters a and the major diameters b of said cross-sections are in the range satisfying the following equation (1)

$$0.1 \leqq a/b \leqq 0.6 \quad (1).$$

3. A method for producing a nubuck man made leather according to claim 2, wherein the production method is characterized in that at least one side of the surfaces of the nonwoven fabric comprising ultrafine-fiber bundles having a single fineness of no greater than 0.2 de and/or fibers convertible into ultrafine-fiber bundles having a single fineness of no greater than 0.2 de is pressed under conditions that the minor diameters a and the major diameters b of the elliptic cross-sections of the above-mentioned ultrafine-fiber bundles and/or fibers convertible into ultrafine-fiber bundles present on the surface of the nonwoven fabric in the product satisfy the following equation (1)

$$0.1 \leqq a/b \leqq 0.6 \quad (1).$$

4. A grain nubuck man made leather, wherein the grain nubuck man made leather is characterized in that:

a nonwoven fabric which constitutes the man made leather comprises ultrafine-fiber bundles having a single fineness of no greater than 0.2 de, the cross-sections of the ultrafine-fiber bundles present on at least one side of the surfaces of the nonwoven fabric are ellipses, the major diameters b of said cross-sections are parallel to a surface of the nonwoven fabric, and the minor diameters a and the major diameters b of said cross-sections are in the range satisfying the following equation (1)

$$0.1 \leqq a/b \leqq 0.6 \quad (1).$$

5. A method for producing a grain nubuck man made leather according to claim 4, wherein the production method is characterized in that at least one side of the surfaces of the nonwoven fabric comprising ultrafine-fiber bundles having a single fineness of no greater than 0.2 de and/or fibers convertible into ultrafine-fiber bundles having a single fineness of no greater than 0.2 is pressed under conditions that the minor diameters a and the major diameters b of the elliptic cross-sections of the above-mentioned ultrafine-fiber bundles and/or fibers convertible into ultrafine-fiber bundles present on the surface of the nonwoven fabric in the product satisfy the following equation (1)

$$0.1 \leqq a/b \leqq 0.6 \quad (1).$$

6. A full grain man made leather, wherein the full grain man made leather is characterized in that:

a nonwoven fabric which constitutes the man made leather comprises ultrafine-fiber bundles having a single fineness of no greater than 0.2 de, the cross-sections of the ultrafine-fiber bundles present on at least one side of the surfaces of the nonwoven fabric are ellipses, the major diameters b of said cross-sections are parallel to a surface of the nonwoven fabric, and the minor diameters a and the major diameters b of said cross-sections are in the range satisfying the following equation (1)

$$0.1 \leqq a/b \leqq 0.6 \quad (1).$$

7. A method for producing a full grain man made leather according to claim 6, wherein the production method is characterized in that at least one side of the surfaces of the nonwoven fabric comprising ultrafine-fiber bundles having a single fineness of no greater than 0.2 de and/or fibers convertible into ultrafine-fiber bundles having a single fineness of no greater than 0.2 de is pressed under conditions that the minor diameters a and the major diameters b of the elliptic cross-sections of the above-mentioned ultrafine-fiber bundles and/or fibers convertible into ultrafine-fiber bundles present on the surface of the nonwoven fabric in the product satisfy the following equation (1)

$$0.1 \leqq a/b \leqq 0.6 \quad (1).$$

* * * * *